US005237917A

United States Patent [19]

Traut et al.

[11] Patent Number: 5,237,917

[45] Date of Patent: Aug. 24, 1993

[54] WIRE MARKING SYSTEM AND A METHOD OF MARKING AN INSULATED WIRE

[75] Inventors: Joseph Traut, Saddle River; Alexander Redel, Elmwood Park, both of N.J.; Edward L. Teller, Wesley Hills, N.Y.

[73] Assignee: AT Information Products, Inc., Mahway, N.J.

[21] Appl. No.: 860,904

[22] Filed: Mar. 31, 1992

[51] Int. Cl.[5] ..... B41F 17/10

[52] U.S. Cl. ..... 101/35; 101/37; 427/558

[58] Field of Search ..... 101/35, 36, 37; 427/54.1

[56] References Cited

U.S. PATENT DOCUMENTS

| | | | |
|---|---|---|---|
| 4,029,006 | 6/1977 | Mercer | 101/35 |
| 4,258,646 | 3/1981 | Kloczewski et al. | 118/50.1 |
| 4,880,849 | 11/1989 | Poole et al. | 427/54.1 |
| 4,888,205 | 12/1989 | Hartman | 427/54.1 |
| 4,904,328 | 2/1990 | Beecher et al. | 427/54.1 |
| 4,999,076 | 3/1991 | Incremona et al. | 156/277 |
| 5,026,608 | 6/1991 | Polato et al. | 427/54.1 |

*Primary Examiner*—Edgar S. Burr
*Assistant Examiner*—Lynn D. Hendrickson
*Attorney, Agent, or Firm*—Francis C. Hand

[57] ABSTRACT

The ink jet wire marking system is provided with a pretreatment station which employs ultraviolet light to clean and condition a travelling wire. Thereafter, the wire passes through an ink jet printing station for the printing of graphics thereon using UV curable inks. Thereafter, the wire passes through a curing station which employs ultraviolet light to cure the ink on the wire. The wire can then be cut into segments or wound up in a continuous mode.

13 Claims, 2 Drawing Sheets

WIRE MARKING SYSTEM AND A METHOD OF MARKING AN INSULATED WIRE

This invention relates to a wire marking system and to a method of marking an insulated wire.

Heretofore, various types of wire marking systems have been known for marking electrical wires and other continuous elastic flexible members, such as described in U.S. Pat. No. 4,029,006. Typically, the wire marking systems have employed a wire storage reel, a wire feed transport, wire guides, an ink jet printer station, an encoder, a coiling pan and related electronic control and interface devices which permit the system to function in an integrated manner. Generally, the systems have been used to prepare the wire for harness manufacture. To this end, the systems have employed means for measuring sections or segments of the wire into pieces, equipment to permit various types of graphics to be applied to the wire such that the graphics are centered and not truncated. Various techniques have also been used to apply the graphics or labels to the wire in various orientation. Still further, cut off equipment has been provided in order to cut the wire into discrete pieces or to rewind the wire back onto a spool.

The techniques which have been employed for applying ink jetted marks on wire, for example as described in U.S. Pat. No. 4,029,006, typically involve solvent based inks which are thermoset for optimum performance. To this end, a thermosetting step has been used which requires gathering of the wire which has previously been measured and marked into batches and baking the wire for a period of time in a separate convection oven until the ink has reached a maximum cure. However, such a separate baking step is undesirable because the step requires additional time, requires more labor, increases the chances for error and generally complicates the process of wire preparation.

Existing methodologies utilized in the printing of wires have also used hot stamping, pin printing and laser marking. Hot stamping is a technique which is often called branding. In this case, the wire which has to be marked is indexed under a heated printing plate and when the wire stops, the heated printing plate is pressed into the wire. The insulation on the wire is thus permanently deformed by the printing plate in a fashion which causes letters or symbols to be permanently branded into the wire. However, this technique causes degradation of the insulation characteristics of the insulation jacketed wire.

Pin printing refers to common dot matrix pin printing techniques which are used in many types of paper printers. This technique can also cause degradation of the insulating jacket of a wire because, in effect, the insulation is being continuously hammered with tiny pins as the label is being applied. This process has the additional disadvantage of being inherently slow and in that the printed marks are less durable than marks printed with other techniques.

Laser marking is a more recently utilized methodology for the application of marks on wire. However, laser markers are also grouped with the technologies which may impair the insulation characteristics of the wire because these markers apply marks by burning or removing a thin layer of insulation away from the substrate. In some cases, laser marking also causes a discoloration of the wire. In such cases, it is necessary to add titanium dioxide to facilitate discoloration. Laser systems also bring the disadvantages of complexity, toxic gases and expense.

Accordingly, it is an object of the invention to improve the marking of wires.

It is another object of the invention to allow a large range of usable substrates for wire marking and to improve the durability of all marks as measured by chemical and mechanical tests.

It is another object of the invention to eliminate the need for any offline baking steps in the printing of traveling lengths of wire.

It is another object of the invention to utilize an ink jet printer for the marking of wires in a high speed and economical manner.

It is another object of the invention to provide a length of wire with permanent markings which are durable without impairment of the wire.

It is another object of the invention to provide a high speed, efficient and economical system for the marking of wires particularly used for wiring harnesses.

Briefly, the invention provides a wire marking system comprising a pretreatment station, a printing station and a post-print curing station. The system is constructed as an in-line system and can be used to mark wire, cable, flat ribbons, fiber optic wire and the like, all of which are within the generically used term "wire" hereinafter.

The pretreatment station is provided with a means for exposing a travelling length of insulated wire to a source of ultraviolet light for cleaning the wire insulation surface. In addition, the exposure of the traveling wire to ultraviolet light prepares the surface of the wire to provide a more permanent bond between the insulating material, i.e. plastic coating, on the wire and the ink subsequently printed thereon so as to provide a more durable mark.

The means for exposing the travelling wire to ultraviolet light includes a source of ultraviolet light, for example, in the form of an ultraviolet light bulb for creating a high energy ultraviolet light. In addition, the means includes a reflector for focusing the ultraviolet light from the bulb onto the travelling wire. For example, use may be made of a pair of reflectors of semi-elliptical shape which together define a tunnel for passage of the wire therethrough.

The printing station is located adjacent the pretreatment station and has an ink jet printing means for printing characters of ultraviolet curable ink onto the travelling length of wire received from the pretreatment station.

The curing station is located adjacent the printing station and has means for exposing the traveling length of wire from the printing station to a source of ultraviolet light for curing the printing characters thereon.

The invention also provides a method of marking the insulated wire which comprises the steps of exposing a travelling length of insulated wire to a source of ultraviolet light for cleaning and conditioning the wire, thereafter ink jet printing characters of ultraviolet curable ink onto the travelling length of wire and thereafter exposing the travelling length of wire to a source of ultraviolet light for curing the printing characters thereon.

The method is suitable for marking wire that is covered with an insulating material such as a fluoropolymer and modifications and composites thereof. For example, the wire may be insulated with a radiation cross-linked fluoropolymer. Basically, the wires may have insulations which are selected from the group which includes, but is not limited to, polyvinyl chloride, polyethylene, polytetrafluoroethylene (Teflon), fluorinatedethylene polypropylene (FEP), FEP/polyimide (Kapton), polyvinylidene fluoride (Kynar), ethylene tetrafluoroethylene (ETFE) and cross-linked, modified, ethylene-tetrafluoroethylene (Tefzel).

These and other objects and advantages of the invention will become more apparent from the following detailed description taken in conjunction with the accompanying drawings wherein.

Figure 1:
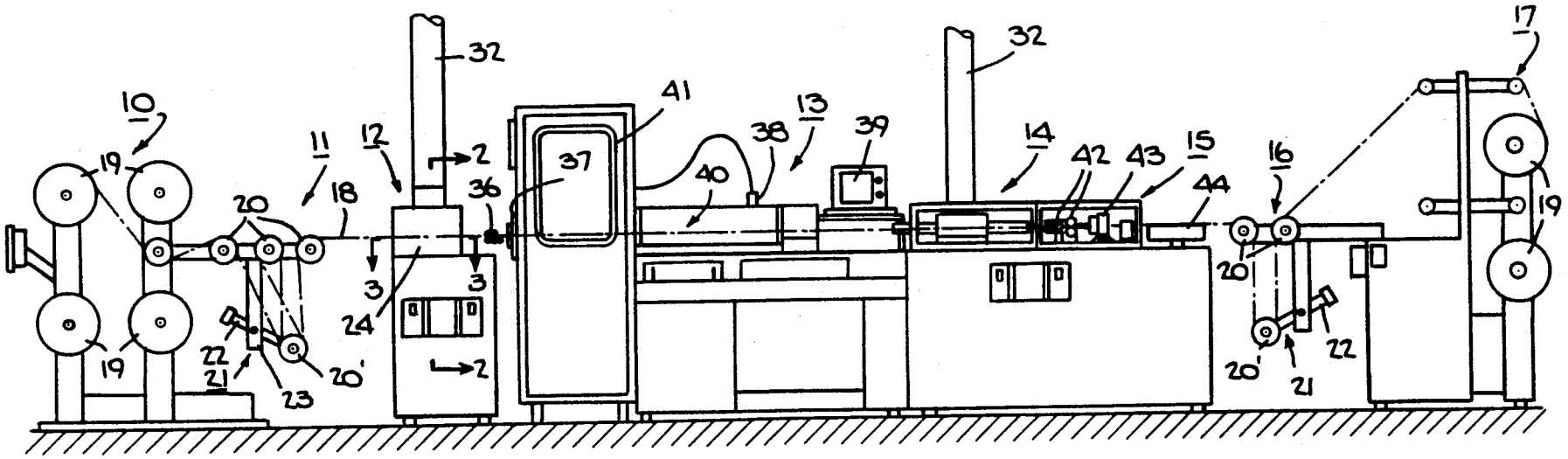
FIG. 1 illustrates a front view of a wire marking system constructed in accordance with the invention.

Referring to FIG. 1, the wire marking system includes a dereeler 10, a pulley type tensioning mechanism 11, a pretreatment station 12, a printing and transport station 13 adjacent the pretreatment station 12, a curing station 14 adjacent the printing and transport station 13, a tension roller and knife assembly 15, a second pulley tensioning mechanism 16 and a spooler 17.

The wire 18 which is processed may be of various wire types including single and multi-conductor wire from 0.030 inch diameter to 0.250 inch diameter. The wire may be of the round concentric wire or jacketed twisted pair wire or any other suitable type of wire or cable.

The dereeler 10 is constructed as a four-spindle dereeler for mounting four reels 19 for storing individual lengths of insulated wire 18 for subsequent feeding to the pretreatment station 12. As indicated, only one reel 19 delivers a length of wire 18 at a time. Each reel 19 is capable of handling, for example, up to 18 inch diameter wire spools and all are powered with a single D.C. motor (not shown) which is electronically synchronized with the remainder of the wire marking system. Of note, single spindle or dual spindle or multi-spindle dereelers may also be used.

The tensioning mechanism 11 is constructed of a plurality of rollers 20 over which the wire passes with one roller 20' being connected with an adjusting device 21 so that the tension in the wire 18 can be adjusted. The adjusting device includes a rod 22 which is pivotally mounted on a bracket 23 and threaded at one end into a support (not shown) for the adjustment roller 20' so the position of the roller 20' can be changed from time-to-time relative to the remaining rollers 20 of the mechanism to thereby adjust the tension in the wire 18.

Figure 2:
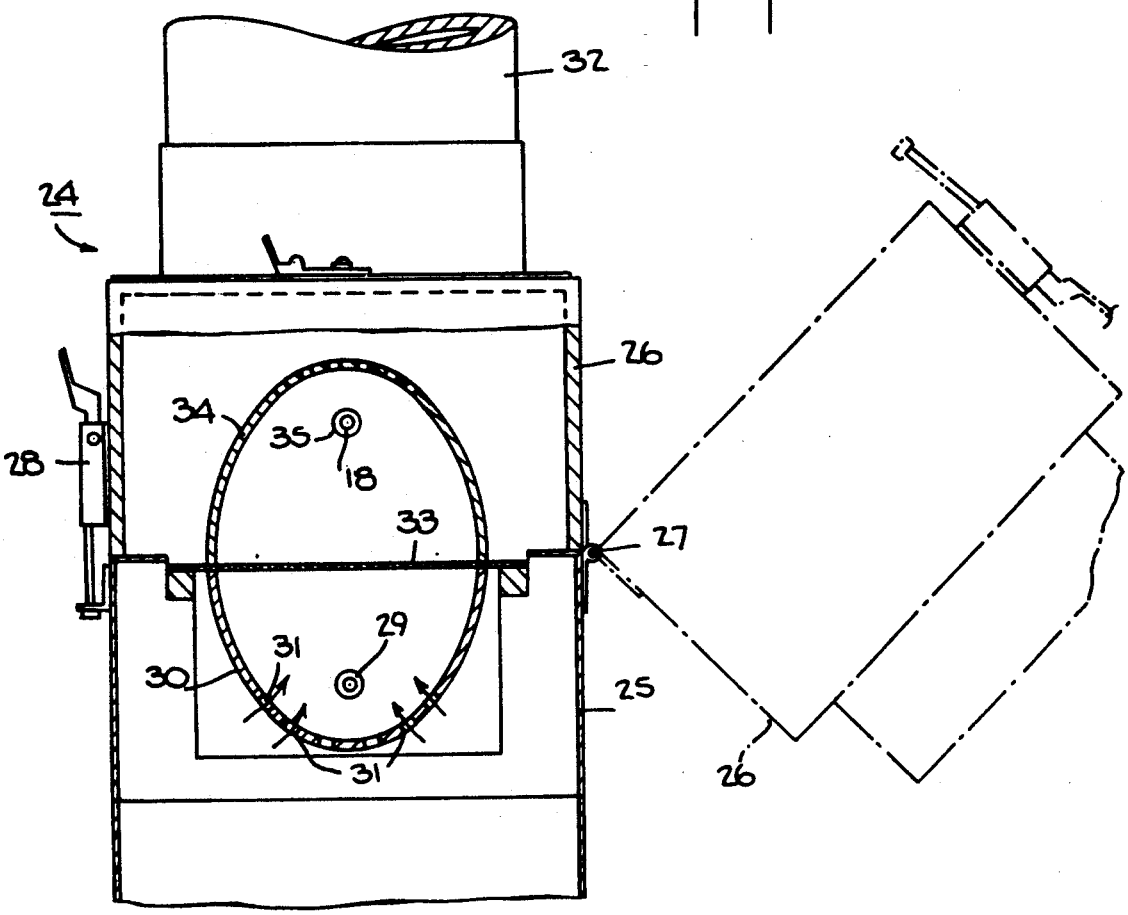
FIG. 2 illustrates a cross-sectional side view of the pretreatment station taken from the upstream end.

Referring to FIG. 2, the pretreatment station which functions as a cleaning and conditioning station 12 has a rigid and compact housing 24 which contains a means for exposing the travelling length of insulated wire to a source of ultraviolet light for cleaning the wire insulation surface. The housing 24 has a base portion 25 and an upper portion 26 which is pivotally mounted to the base portion 25, for example, by a hinge 27 at the rear. Suitable locks 28 may also be provided to secure the upper portion 26 to the base portion 25. As indicated in FIG. 2, the base portion 25 houses an ultraviolet light bulb 29 which serves as a source of ultraviolet light and which emits high energy ultraviolet light. The bulb 29, for example, is made of quartz and has a tapered shape which optimizes the UV, thermal and microwave properties. Such a bulb 29 is sold by Fusion Systems Corporation under the designation H-bulb for a EPIQ 6000 Irradiator, Model 1600 and has a length of 10 inches.

Figure 3:
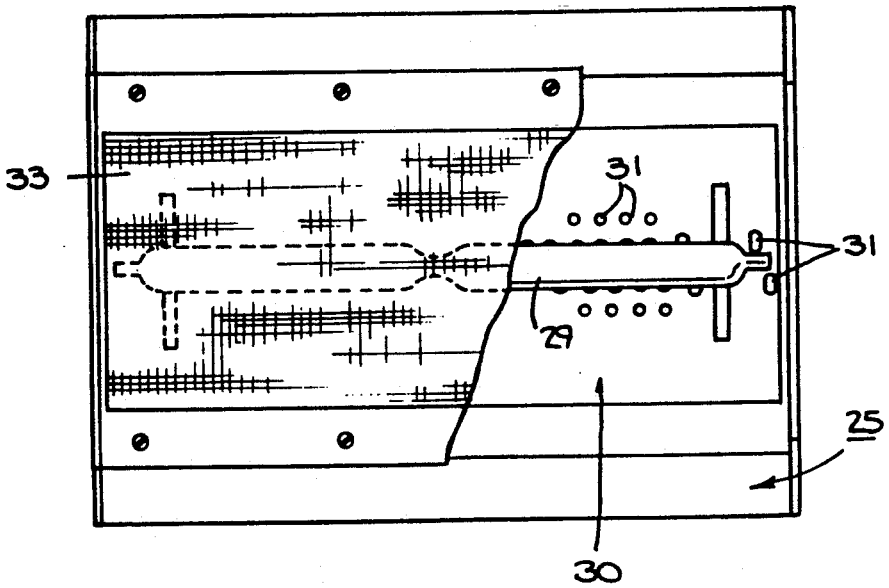
FIG. 3 illustrates a plan view of the lower half of the pretreatment station as constructed in accordance with the invention.

As indicated in FIGS. 2 and 3, the base portion 25 also includes an elliptical reflector 30 disposed about the light bulb 29. This reflector 30 is of known construction and is provided with a plurality of cooling air holes 31. A suitable cooling circuit may also be connected with the housing 24 so as to deliver air under a slight pressure, for example, via a supply pipe 32 (see FIG. 2) and to withdraw air through a vent pipe (not shown).

The base portion 25 also has a RF screen 33 secured over the elliptical reflector 30 and light bulb 29. This screen 33 is of wire mesh type and is employed to prevent unwanted microwave energy from escaping the housing 24. An RF sensor (not shown) may also be mounted on the housing 24 in order to detect an over abundance of microwave energy exiting from the housing 24 and to emit a suitable alarm and/or shut down the pretreatment station 12.

As indicated in FIG. 2, the upper portion 26 of the housing 24 contains an elliptical reflector 34 which is complementary to the reflector 30 in the base portion 25 so as to form a tunnel therewith for passage of the wire 18 therethrough. As indicated, the wire 18 travels above the bulb 29 and wire screen mesh 33. In addition, the wire 18 can be positioned within the tunnel defined by the reflectors 30, 34 so that the ultraviolet light from the lamp 29 is focused on a path through which the wire 18 travels.

The upper portion 26 of the housing 24 is also provided with an entry opening 35 on an upstream side to permit entry of the wire 18 as well as an exit (not shown) on a downstream side to permit exiting of the wire 18 from the housing 24.

During passage through the pretreatment station 12, a wire 18 which may have manufacturing materials thereon or other impurities is subjected to the focused ultraviolet light generated by the UV light bulb 29. It has been found that the UV light bulb generates sufficient energy and heat so as to clean the manufacturing materials from the wire along with the other impurities. In addition, the light appears to effect a molecular reaction on the surface of the wire, for example, in the form of molecular bonding sites, since the ink jet markings which are made are permanent, clean and sharp as compared to previously known ink jet applied markings.

Generally, the UV light bulb 29 and a power supply (not shown) therefor are selected and matched for treating aircraft wire. The bulb 29 serves to emit short wave UV light which oxidizes (cleans) foreign materials from the surface of the wire 18 and makes the wire 18 more printable. The UV light also creates extra bonding sites on the surface of the wire which enhance adhesion of ultraviolet curable inks to the wire 18 during a subsequent ink jet printing process.

The housing 24 of the cleaning and conditioning station 12 can be raised and lowered and otherwise adjusted relative of the path of the wire 18 and also contains a power supply and lamp interlocks (not shown). The power supply may also incorporate an easy on/off/standby control as well as diagnostic and fault indicators while being fully integrated with the machine control system.

During operation of the cleaning station 12, the elliptical reflectors 30, 34 focuses maximum UV energy on the wire 18 passing through the tunnel provided by the reflectors 30, 34. In this respect, a high UV energy output is produced with low infrared emission.

The cleaning station 12 can also be equipped with an easy to use wire threading mechanism (not shown) to initially feed the wire 18 into position for processing.

The printing and transport station 13 is of generally known construction and includes a wire straightener 36, knot detector 37, splice detector, ink jet printer 38, display panel (not shown), transport unit 40 and machine control computer 41.

The wire straightener 36 serves to remove kinks and "memory" from a wire passing therethrough. The knot detector 37 may be of the sliding funnel type in which various wire diameters may be accommodated by adjusting a control knob located on the outside of the printing station 13. Movement of the funnel trips a limit switch which stops the transport unit 40 immediately. In this regard, knots must be of a minimum size of twice the outside diameter of the wire to be detected.

The splice detector (not shown) may be of a continuity type so as to detect uninsulated wire sections in the travelling wire length. Such a detector will permit the system to shut down immediately upon detection of a bare wire splice in order to enable an operator to clear the splice.

The display panel (not shown) may be provided with various light indicators to notify an operator when the system is ready to mark wire and to identify faults. Fault warnings may also appear on a cathode ray tube (CRT) 39 of the system.

The ink jet printer 38 is of the non-contact type so as to avoid indenting or impairing the integrity of the insulation on the travelling wire 18. Any suitable industrial grade continuous small character ink jet printer may be used. Further, ink and make-up solution may be supplied by cartidges. Further, the ink system may be equipped with an automatic viscosity control to maintain quality printing during continuous operation.

The ink jet printer 38 may have a print head which is supplied with a 60–75 micron nozzle for standard print size or a 35–60 micron nozzle for printing very small characters on small diameter wire. The inks which may be used are those which are generally commercially available. However, a UV curable ink must be used. The print head may be mounted so as to be adjustable relative to the wire guide blocks in both a vertical up and down direction and a horizontal front and back direction.

The ink jet printer may also contain a micro-processor which supports computerized printing of variable information in a variety of print formats.

The ink jet printer 38 operates so as to provide highly legible print which is very durable in aircraft wire applications and which passes all commercial and military airplane wire specifications including friction rub tests and fluid immulsion tests.

The transport unit 40 is located in the printing and transport station 13 for feeding the wire 18 from a reel 19 through the cleaning station 12 to the printing station 13. To this end, the transport unit 40 includes transporter belts (not shown) having a gum rubber contact surface that would minimize slippage. In addition, the wire transport belts may be provided with an adjustable tensioning device in order to tension the belts. Still further, the transport unit 40 includes individual wire guide blocks, for example of stainless steel which have a fixed common center method of mounting and which are easily changeable. These guide blocks are selected based upon representative wire sizes. For example, the blocks may be provided in a set to permit interchangeability. The transport unit 40 is programmed to cooperate with the drive motor of the dereeler 10 so as to maintain the travelling wire without sag and without any particular tension in the wire 18.

The machine control computer 41 is PROM-based and uses no magnetic disc of any kind. Any suitable machine control computer can be used such as that presently available on an AUTOPRINT wire marker sold by AT Information Products, Inc. of Mahwah, N.J.

The curing station 14 is constructed in a similar fashion to the treatment station 12, as described above, and contains a long wave UV lamp (not shown), such as a D-bulb (mercury) sold by Fusion Systems Corporation in the above indicated Model 1600.

The curing station 14 also contains a matched power supply which causes rapid curing and adhesion of the UV curable inks used in the printing station 13. The curing station 14 is configured to give uniform curing over the entire printed region and is matched with the pretreatment lamp 24 of the cleaning station 12 to maximize print permanence. This carefully matched combination of UV pretreatment and UV post-printed curing produces printed wire that has exceptional rub test permanence and strong resistance to aircraft fluids such as jet fuel and hydraulic fluid. By way of example, the H bulb 29 operates under low power in a spectral range having a wave length of 200 to 250 nanometers while the D-bulb of the curing station 14 operates in a spectral range having a wave lenth of 350 to 390 nanometers. The bulb of the curing station 14 may also be operated under a low power of 400 watts or a high power of 600 watts depending upon the insulation material, i.e. plastic coating being treated.

The curing station 14 has a rigid and compact housing, for example, constructed of heavy gauge aluminum which contains the UV lamp, an elliptical reflector, as above, microwave generators and lamp interlocks. The construction of the curing station 14 is thus similar to that of the cleaning station 12. In addition, the curing station 14 is equipped with a wire threading mechanism (not shown).

The tension roller and knife assembly 15 employs a suitable transport unit which has a pair of rollers 42, such as polyurethane rollers, which are driven by the servomotor of the transport unit 40 to maintain a slight constant tension on the wire 18 passing through the curing station 14. Both pressure and torque may be adjustable.

The assembly 15 also has a knife mechanism 43 in the form of a cutting blade having a tapered edge to ensure clean cuts at a predetermined cut location.

The cutting station also includes a pair of rollers upstream of the cutting blade 43 which serve to pull slack from the wire 18 and are driven from the transport unit 40 through a suitable transmission as well as through a suitable slip clutch so as to ensure that a wire 18 is pulled very gently through the curing station 14 to the cutting blade 43.

The system may be provided with an ATIP Smartencodr TM which uses a system encoder and segment pulses to track and control wire position to the knife mechanism 43. This controller also serves to control the wire measuring and positioning mechanisms. The operation of the controller can be customized by a PC AT operator interface computer via a serial link. This feature optimizes wire handling for individual wire sizes.

As indicated, a coiling pan 44 is positioned adjacent the knife mechanism at the cutting station to receive cut wires which are expelled from the knife mechanism 43. This coiling pan 44 has smooth edges and is powered to facilitate wire coiling in the pan. The rotation of the coiling pan 44 is synchronized with the transporter wire speed. In addition, suitable air jets (not shown) can be provided to emit momentary pulses of air in the knife mechanism 43 to assist in ejecting short lengths of wire.

The tensioning mechanism 16 and spooler 17 operate in known manner when the wire marker system is alternatively used in a continuous filament mode. The tensioning mechanism 16 is constructed in similar fashion to the upstream tensioning mechanism 11 and like reference characters indicate like parts as above. The spooler 17 is constructed in similar fashion to the dereeler 10 and includes a pair of drive reels 19.

The wire marking system may be operated in a manual mode or an automatic mode. Suitable switches can be provided for this purpose. Under manual operation, batch count, wire code and length can be set via a keyboard with wire codes of up to 96 characters being input via the keyboard. Under computer control, wire length, wire code and wire type can be downloaded from a host computer. This information will be automatically loaded and displayed on the CRT. Each wire code may contain up to 96 characters.

Either control mode (manual or automatic) may be used with either segment cut mode or continuous filament mode.

During operation, an adjustable time delay is provided between cutting wire and resuming wire movement. This allows an operator to remove wire from the coiling pan 44. In the single segment mode, there is a fixed time delay of 0.5 seconds during which time the segment is cut and removed from the coiling pan. In the batch run mode, the operator can push the "pause and continue" button to increase time to remove a complete batch of wire segments from the coiling pan. The "pause and continue" feature also gives the operator the capability for adjustable on-demand time delays which can be used for other tasks such as retrieving, tagging, tying, bagging, sorting, et al.

A batch counter may be provided which can be set from a keyboard in all modes of operation to allow multiple cuts of wire with the same code.

The system may be operated continuously until a wire type or wire gauge change is indicated. Thereafter, the operator must change the wire spools, adjust the knot detector and guide blocks.

If a wire splice or printer fault occurs, or a safety interlock is open, the CRT can be programmed to display a fault condition so that the system shuts down until the condition is corrected. Thereafter, the system can be restarted.

The system is constructed so as to operate at speeds up to 350 feet per minute. Further, the wire may be cut smoothly without burrs, frayed ends or distortion in lengths ranging from 12 inches to 9,999 inches.

The system may be operated, for example, so that during a start-up time, the wire is moved at a slow speed while the power to the respective UV bulbs is being ramped up to the normal operating power. In this way, the speed of the wire in the pretreatment station 12 and curing station 14 are controlled to expose the wire insulation to the desired UV dosage during the UV tunnel warm up period.

The system includes software and an electronic controller which controls and synchronizes the movement of wire (and cable) through the ultraviolet pretreatment and ultraviolet curing (post-print) stations 12, 14 with all other elements of an integrated in-line system.

During operation, wire is drawn off the dereeler 10 and passed through the pretreatment station 12 in which the wire is passed through the ultraviolet light so as to be cleansed and prepared for the printing process. Thereafter, the wire passes through the printing station 13 in which printed characters are placed on the surface of the wire and particularly on the insulation or plastic coating about the wire. Next, the wire passes through the curing station 14 wherein the ink is cured. In this respect, the transport unit 40 and knife mechanism 43 are operated in synchronism with the printing station 13 to effect cutting of the wire into predetermined increments of length. Alternatively, the wire may be wound up in a continuous filament mode.

The invention thus provides an ink jet wire marking system which is of modular construction to facilitate shipping and handling. In addition, the system is a totally integrated turn-key system.

The invention also provides a universal wire marker to produce marked wire on a broad range of insulation types with increased permanence without the extra off-line step of thermosetting in a conventional oven.

What is claimed is:

1. A wire marking system comprising a pretreatment station having means for exposing a travelling length of insulated wire to a source of ultraviolet light for cleaning and conditioning the wire insulation surface, said means including an ultraviolet light bulb having means for creating high energy ultraviolet light and at least one reflector defining a tunnel for passage of a travelling wire therethrough and for focusing said light from said bulb onto the travelling wire;

a printing station adjacent said pretreatment station having an ink jet printing means for printing characters of ultraviolet curable ink onto a travelling length of wire received from said pretreatment station; and a curing station adjacent said printing station having means for exposing a travelling length of wire from said printing station to a source of ultraviolet light for curing the printing characters thereon.

2. A system as set forth in claim 1 which further comprises a reel for storing a length of insulated wire for feeding to said pretreatment station and a transport unit between said curing station and said printing station for feeding wire from said reel through said pretreatment station to said printing station.

3. A system as set forth in claim 2 which further comprises a cutting station having a knife mechanism for cutting a length of wire received from said curing station into predetermined segments.

4. A system as set forth in claim 3 which further comprises a coiling pan for receiving and coiling segments of cut wire from said knife mechanism.

5. A system as set forth in claim 3 which further comprises a controller unit for synchronizing operation of said transport unit and said knife mechanism with said printing means.

6. A system as set forth in claim 1 wherein said means in said pretreatment station includes an entry for directing a travelling wire by said reflector and an exit for leading a travelling wire away from said reflector.

7. A system as set forth in claim 1 wherein said printing station includes an ink jet print head for printing characters of ink onto a wire travelling through said printing station.

8. A system as set forth in claim 1 wherein said source of ultraviolet light in said curing station is a quartz light bulb having means for creating high energy ultraviolet light.

9. A system as set forth in claim 8 wherein said means in said curing station includes at least one reflector defining a tunnel for passage of a travelling wire therethrough and for focusing said light therefrom onto the travelling wire.

10. A wire marking system comprising a pretreatment station having means for exposing a travelling length of insulated wire to a source of ultraviolet light for cleaning and conditioning the wire insulation surface to form molecular bonding sites thereon;

a printing station adjacent said pretreatment station having an ink jet printing means for printing characters of ultraviolet curable ink onto the conditioned surface of a travelling length of wire received from said pretreatment station; and a curing station adjacent said printing station having means for exposing a travelling length of wire from said printing station to a quartz light bulb having means for creating high energy ultraviolet light for curing the characters printed thereon, and at least one reflector defining a tunnel for passage of a travelling wire therethrough and for focusing said light therefrom onto the travelling wire.

11. A system as set forth in claim 10 wherein said source of ultraviolet light in said pretreatment station is an ultraviolet light bulb having means for creating high energy ultraviolet light.

12. A system as set forth in claim 10 wherein said means in said curing station includes an entry for directing a travelling wire by said reflector and an exit for leading a travelling wire away from said reflector.

13. A system as set forth in claim 10 wherein said source of UV light in said pretreatment station is a quartz light bulb having an operating spectrum of from 200 to 250 nanometers and said source of UV light in said curing station is a quartz light bulb having an operating spectrum of from 350 to 390 nanometers.

* * * * *